US010285543B1

(12) United States Patent
Hall

(10) Patent No.: US 10,285,543 B1
(45) Date of Patent: May 14, 2019

(54) KIT FOR PERSONALIZING A BATH MAT

(71) Applicant: Levenston Hall, St. Louis, MO (US)

(72) Inventor: Levenston Hall, St. Louis, MO (US)

( * ) Notice: Subject to any disclaimer, the term of this patent is extended or adjusted under 35 U.S.C. 154(b) by 0 days.

(21) Appl. No.: 15/590,198

(22) Filed: May 9, 2017

(51) Int. Cl.

| | |
|---|---|
| ***G09F 3/10*** | (2006.01) |
| ***A47K 3/28*** | (2006.01) |
| ***A47K 3/00*** | (2006.01) |
| ***G09F 3/02*** | (2006.01) |

(52) U.S. Cl.
CPC ..... *A47K 3/281* (2013.01); *A47K 3/002* (2013.01); *G09F 3/02* (2013.01); *G09F 3/10* (2013.01); *G09F 2003/023* (2013.01)

(58) Field of Classification Search
CPC ..... A47K 3/002
USPC ..... 4/580–583
See application file for complete search history.

(56) References Cited

U.S. PATENT DOCUMENTS

| | | | | | |
|---|---|---|---|---|---|
| 1,861,389 | A | | 5/1932 | Grosjean | |
| 2,769,265 | A | * | 11/1956 | Page | C25D 11/04 205/153 |
| 3,043,025 | A | | 7/1962 | Semon | |
| 3,176,057 | A | * | 3/1965 | Peters | B29C 45/14 101/170 |
| 3,408,663 | A | | 11/1968 | Bunting | |
| 4,625,344 | A | * | 12/1986 | Howard | A47K 3/002 4/581 |
| 4,931,330 | A | * | 6/1990 | Stier | A47K 3/002 4/582 |
| D322,003 | S | | 12/1991 | Hytry | |
| 5,069,951 | A | | 12/1991 | Egan | |
| 5,375,271 | A | * | 12/1994 | Frankel | A47K 3/002 374/162 |
| 5,776,605 | A | * | 7/1998 | May | A47K 3/002 4/580 |
| 5,781,941 | A | * | 7/1998 | Radke | A47K 3/002 4/583 |
| 6,014,779 | A | | 1/2000 | Lindholm | |
| 6,177,189 | B1 | * | 1/2001 | Rawlings | C09J 7/22 428/343 |
| 6,530,096 | B1 | * | 3/2003 | Mayhew | A47K 3/002 4/580 |
| 6,564,397 | B1 | * | 5/2003 | Hawley | A47K 3/002 4/580 |
| 6,626,678 | B2 | * | 9/2003 | Forbes | A63F 9/0666 273/153 R |
| 7,252,431 | B1 | * | 8/2007 | Caramanna | G01K 1/14 116/216 |

(Continued)

FOREIGN PATENT DOCUMENTS

WO 2004004532 A2 1/2004

*Primary Examiner* — Lori Baker

(57) ABSTRACT

The kit for personalizing a bath mat is a set of one or more appliques that may be applied to the floor of a bathroom washing facility or to a bath mat. The appliques may improve the appearance of the surface to which they are applied. The appliques may improve the safety characteristics of the surface to which they are applied by providing a non-slip surface. Embodiments of the kit for personalizing a bath mat may be applied directly to a shower or bathtub floor or to a commercially available bath mat. Embodiments of the kit for personalizing a bath mat may comprise a specific bath mat with designated targets for guiding placement of the appliques or having superior bonding characteristics for the adhesive backing of the appliques.

9 Claims, 4 Drawing Sheets

(56) References Cited

U.S. PATENT DOCUMENTS

| | | | | |
|---|---|---|---|---|
| 7,520,003 | B2 * | 4/2009 | Meyers | A47K 3/002 4/583 |
| 7,636,960 | B2 | 12/2009 | Hawley | |
| 8,475,905 | B2 * | 7/2013 | Abrams | D06P 5/004 428/343 |
| 9,714,513 | B2 * | 7/2017 | Hamp | E04F 11/02 |
| 9,738,998 | B2 * | 8/2017 | Scott | D05B 19/12 |
| 2004/0128896 | A1 * | 7/2004 | Baldwin | A47G 1/0622 40/768 |
| 2004/0139527 | A1 * | 7/2004 | Damir | A41B 13/06 2/83 |
| 2012/0094057 | A1 * | 4/2012 | Bartlett | B32B 37/153 428/92 |
| 2014/0338274 | A1 * | 11/2014 | Hamp | B32B 37/04 52/182 |
| 2016/0016028 | A1 * | 1/2016 | Thompson | A63B 21/4037 5/417 |
| 2016/0201240 | A1 * | 7/2016 | Scott | D05B 19/12 112/475.19 |

* cited by examiner

KIT FOR PERSONALIZING A BATH MAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of bathroom safety and aesthetics, more specifically, a kit for personalizing a bath mat.

SUMMARY OF INVENTION

The kit for personalizing a bath mat is a set of one or more appliques that may be applied to the floor of a bathroom washing facility or to a bath mat. The appliques may improve the appearance of the surface to which they are applied. The appliques may improve the safety characteristics of the surface to which they are applied by providing a non-slip surface. Embodiments of the kit for personalizing a bath mat may be applied directly to a shower or bathtub floor or to a commercially available bath mat. Embodiments of the kit for personalizing a bath mat may comprise a specific bath mat with designated targets for guiding placement of the appliques or having superior bonding characteristics for the adhesive backing of the appliques.

An object of the invention is to provide a kit for enhancing the appearance of a bathroom washing facility of a bath mat.

Another object of the invention is to provide a kit for enhancing the safety characteristics of a bathroom washing facility or bath mat.

These together with additional objects, features and advantages of the kit for personalizing a bath mat will be readily apparent to those of ordinary skill in the art upon reading the following detailed description of the presently preferred, but nonetheless illustrative, embodiments when taken in conjunction with the accompanying drawings.

In this respect, before explaining the current embodiments of the kit for personalizing a bath mat in detail, it is to be understood that the kit for personalizing a bath mat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the kit for personalizing a bath mat.

It is therefore important that the claims be regarded as including such equivalent construction insofar as they do not depart from the spirit and scope of the kit for personalizing a bath mat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive. As used herein, the term "bathroom washing facility" is intended to mean a shower, bathtub, or other bathroom fixture which may be wet during use and which people stand in to enter, exit, or use for washing themselves.

Figure 1:
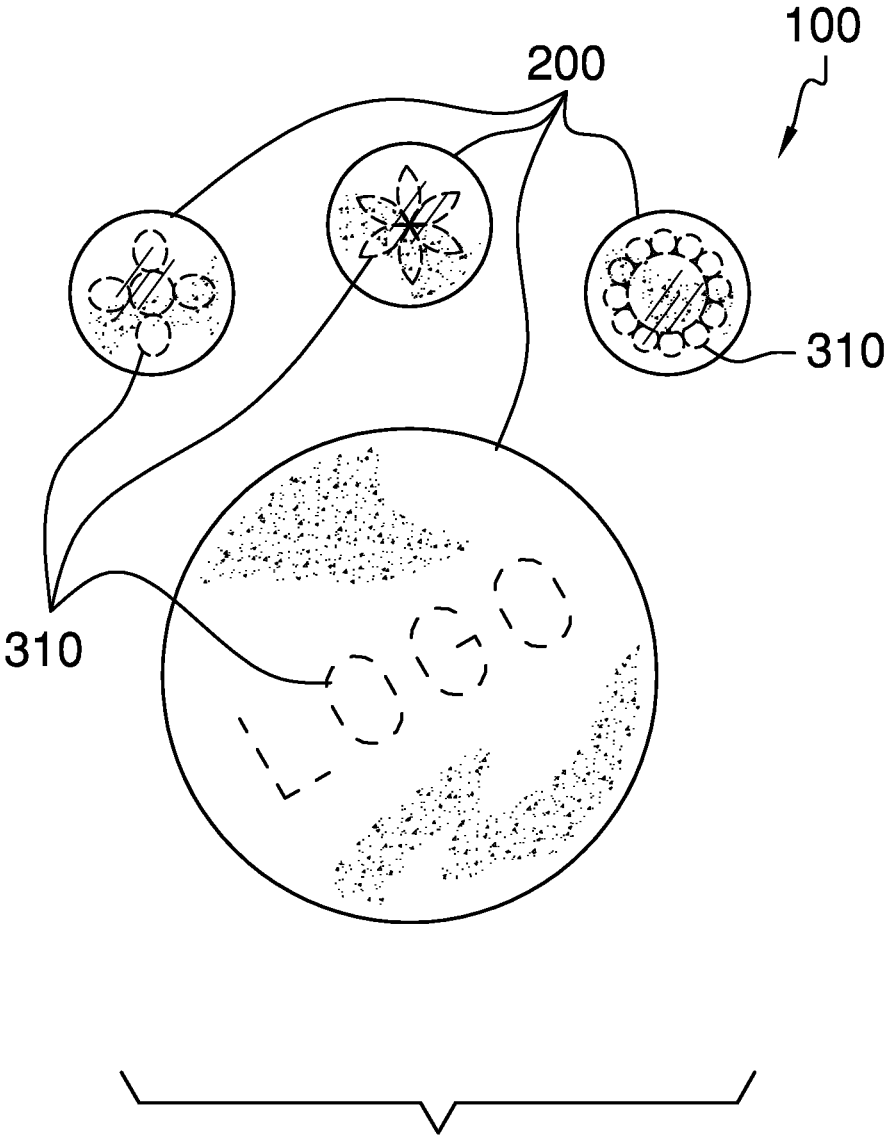
FIG. 1 is a perspective view of an embodiment of the disclosure.
Figure 2:
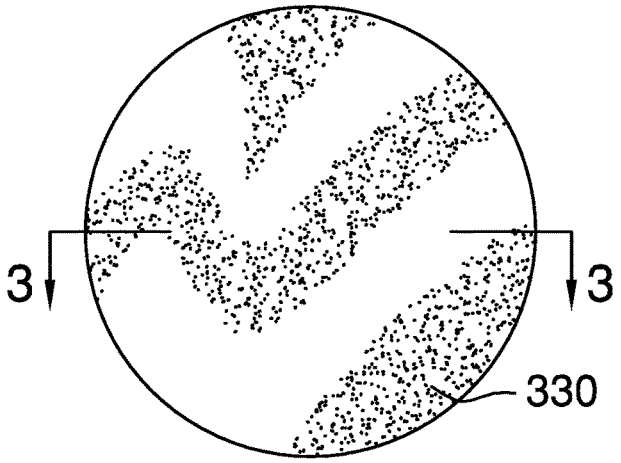
FIG. 2 is a bottom view of an embodiment of the disclosure.
Figure 3:
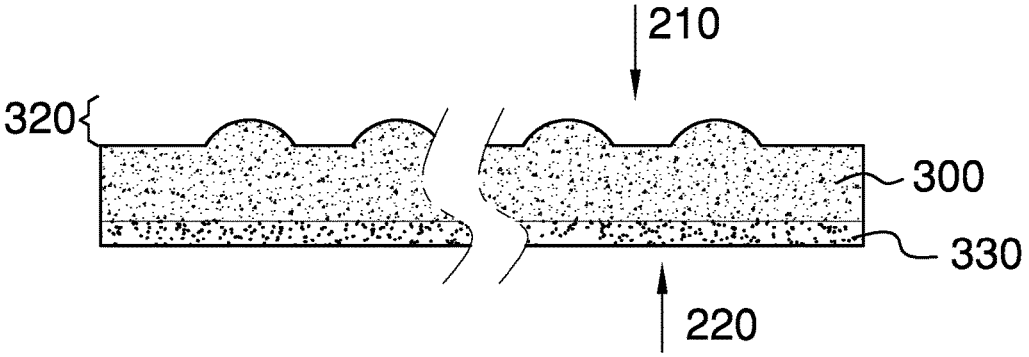
FIG. 3 is a cross-sectional view of an embodiment of the disclosure across 3-3 as shown in FIG. 2.
Figure 4:
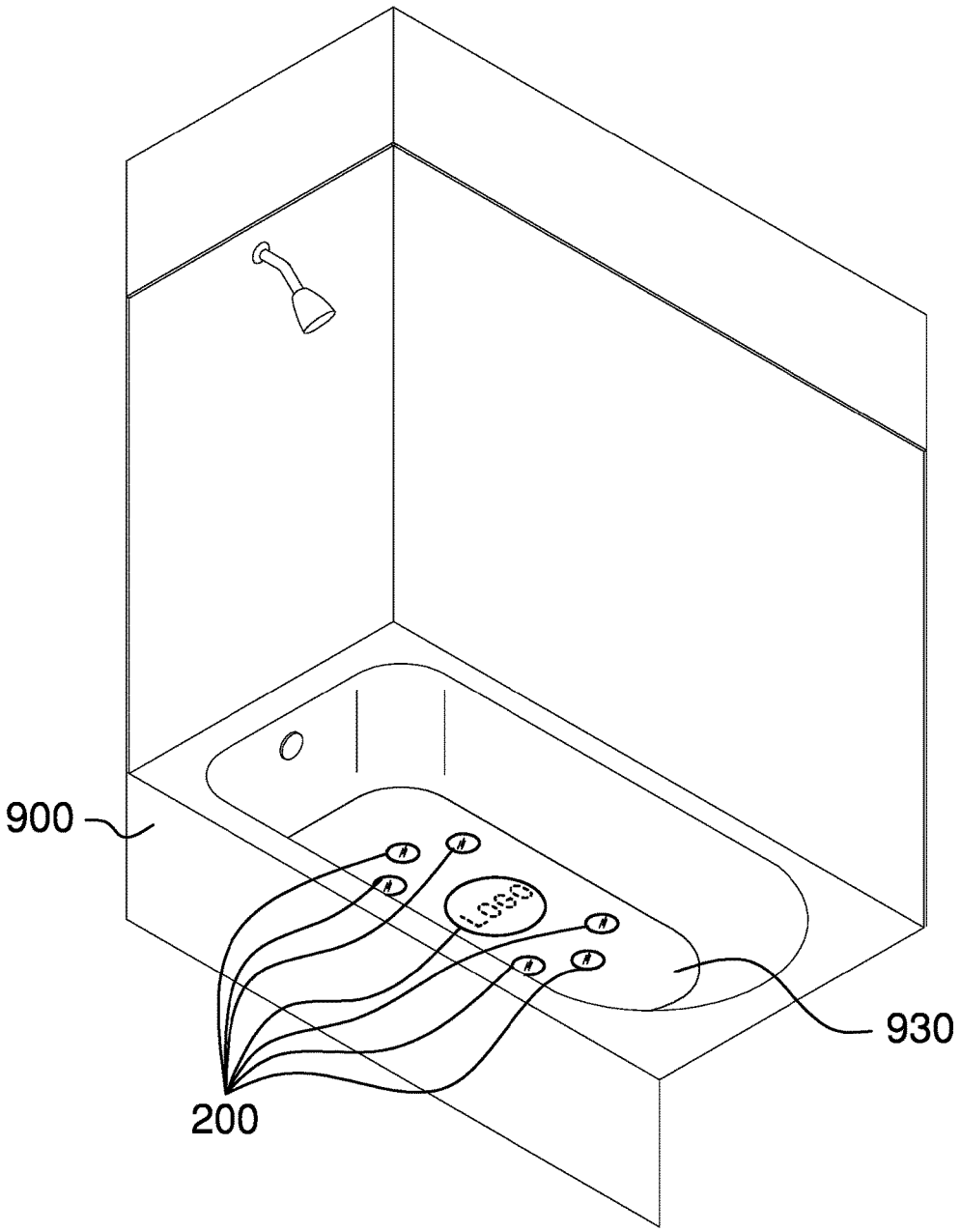
FIG. 4 is a perspective view view of an embodiment of the disclosure in use in a bath tub.
Figure 5:
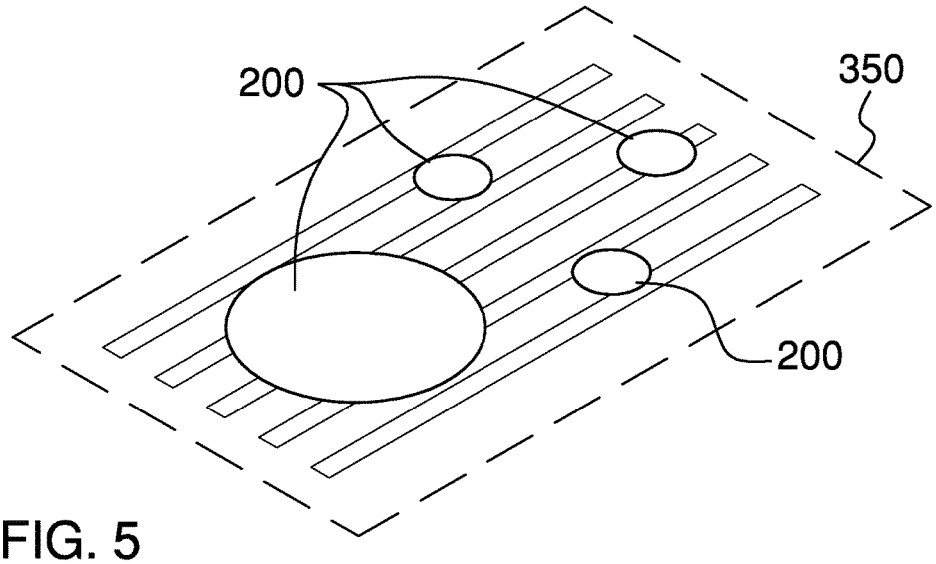
FIG. 5 is a perspective view of an embodiment of the disclosure applied to a commercially available bath mat.
Figure 6:
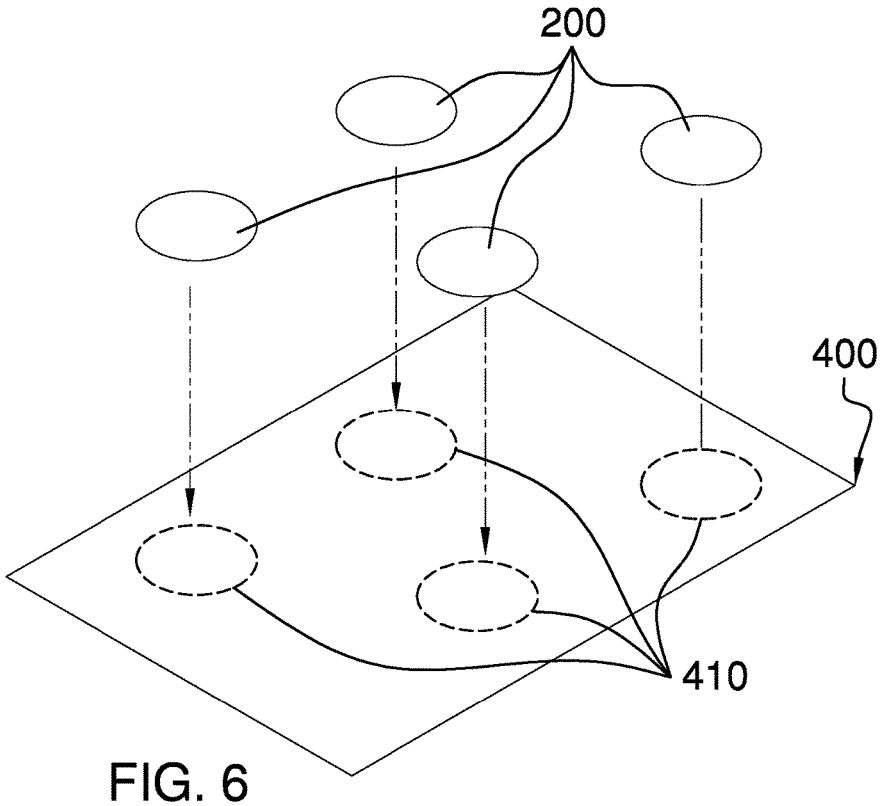
FIG. 6 is a perspective view of a an embodiment of the disclosure showing the one or more customizing appliques being applied to a bath mat with designated targets.

Detailed reference will now be made to a first potential embodiment of the disclosure, which is illustrated in FIGS. 1 through 6.

The kit for personalizing a bath mat 100 (hereinafter invention) comprises one or more customizing appliques 200. The kit for personalizing a bath mat 100 provides a visual and safety improvement to a bathroom washing facility 900. Each of the one or more customizing appliques 200 provides a decorative element and a non-slip surface to the bathroom washing facility 900.

Each of the one or more customizing appliques 200 comprises an applique body 300, a decorative image 310, a non-slip surface 320 and an adhesive backing 330. The applique body 300 may be composed of plastic, vinyl, or a rubberized material. The applique body 300 may be a geometric shape or it may be a shape selected to complement the decorative image 310. As non-limiting examples, the shape of the applique body 300 may be a circle, triangle, square, or other geometric shape. As further non-limiting examples, the applique body 300 may have a scallop-shaped edge to complement the decorative image 310 which is a flower or may have a shape that is uniformly offset from the edge of the decorative image 310.

The applique body 300 is generally thin so as to not be a tripping hazard. In a preferred embodiment, the thickness of the applique body 300 as measured from highest part of a top surface 210 to a bottom surface 220 is less than or equal to 15 mm.

The decorative image 310 may be textual, graphical, or a combination of the two. The decorative image 310 is permanently fixed to the applique body 300 and is visible as the top surface 210 of the one or more customizing appliques 200. As a non-limiting example, the decorative image 310 may be a bible passage, an uplifting message, a humorous line, or other text. As a further non-limiting example, the decorative image 310 may be an image of a super-hero emblem, a cartoon character, a flower, a ladybug, a sports team emblem, or other graphical image.

The non-slip surface 320 may be a textured surface that provides improved traction between the one or more customizing appliques 200 and a foot (not shown in the figures) of a person (not shown in the figures). The non-slip surface 320 may be a regular pattern molded into the top surface 210 of the one or more customizing appliques 200. As non-limiting examples, the non-slip surface 320 may be a pattern of ridges or bumps. The non-slip surface 320 may be a uniform irregular surface on the top surface 210 of the one or more customizing appliques 200.

The adhesive backing 330 may be a marine-grade adhesive, which is applied as a step during installation or which is pre-applied and covered with a peel-off backing.

In some embodiments, the one or more customizing appliques 200 comprising the kit for personalizing a bath mat 100 are applied directly and permanently to a floor 930 of the bathroom washing facility 900. In some embodiments, the one or more customizing appliques 200 comprising the kit for personalizing a bath mat 100 are applied permanently to a commercially available bath mat 350 where they may enhance or complement the color and imagery of the commercially available bath mat 350 and improve the safety characteristics of the commercially available bath mat 350. As a non-limiting example, the one or more customizing appliques 200 may be similar or complementary colors to the colors of the commercially available bath mat 350. As a non-limiting example, the one or more customizing appliques 200 may be provide flower images, which enhance floral imagery already on the commercially available bath mat 350.

The kit for personalizing a bath mat 100 may further comprise a bath mat with designated targets 400. The bath mat with designated targets 400 may be a bathtub mat with one or more designated targets 410 intended to guide placement of the one or more customizing appliques 200. The bath mat with designated targets 400 may be a vinyl or rubberized mat with its own thematic color, shape, and imagery. The bath mat with designated targets 400 may indicate, using texture, color, or other designations, the one or more designated targets 410 intended to guide placement of the one or more customizing appliques 200. The one or more designated targets 410 may provide a superior surface for placement of the one or more customizing appliques 200. As a non-limiting example, one or more designated targets 410 may provide a surface with superior bonding characteristics for the adhesive backing 330.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A kit for personalizing a bath mat comprising:

one or more customizing appliques;

wherein the kit for personalizing a bath mat provides a visual and safety improvement to a bathroom washing facility;

wherein each of the one or more customizing appliques provides a decorative element;

wherein each of the one or more customizing appliques provides a non-slip surface to the bathroom washing facility;

wherein each of the one or more customizing appliques comprise an applique body, a decorative image, a non-slip surface and an adhesive backing;

wherein the applique body is composed of plastic, vinyl, or a rubberized material;

wherein the applique body is a geometric shape or it is a shape selected to complement the decorative image;

wherein the decorative image is textual, graphical, or a combination of the two;

wherein the decorative image is permanently fixed to the applique body;

wherein the decorative image is visible as the top surface of the one or more customizing appliques;

wherein the non-slip surface is a textured surface that is adapted to provide improved traction between the one or more customizing appliques and a foot of a person;

wherein the thickness of the applique body as measured from highest part of a top surface to a bottom surface is less than or equal to 15 mm so as to not be a tripping hazard;

wherein the adhesive backing is a marine-grade adhesive which is applied as a step during installation.

2. The kit for personalizing a bath mat according to claim 1 wherein the non-slip surface is a regular pattern molded into the top surface of the one or more customizing appliques.

3. The kit for personalizing a bath mat according to claim 1 wherein the non-slip surface is a uniform irregular surface on the top surface of the one or more customizing appliques.

4. The kit for personalizing a bath mat according to claim 1 wherein said adhesive backing is pre-applied and covered with a peel-off backing.

5. The kit for personalizing a bath mat according to claim 1 wherein the one or more customizing appliques comprising the kit for personalizing a bath mat are applied directly and permanently to a floor of the bathroom washing facility.

6. The kit for personalizing a bath mat according to claim 1 wherein the one or more customizing appliques are applied permanently to a commercially available bath mat;

wherein the one or more customizing appliques complement the color and imagery of the commercially available bath mat;

wherein the one or more customizing appliques improve the safety characteristics of the commercially available bath mat.

7. The kit for personalizing a bath mat according to claim 1 wherein the kit for personalizing a bath mat further comprises a bath mat with designated targets;

wherein the bath mat with designated targets is a bathtub mat with one or more designated targets intended to guide placement of the one or more customizing appliques.

8. The kit for personalizing a bath mat according to claim 7 wherein the bath mat with designated targets is a vinyl or rubberized mat with its own thematic color, shape, and imagery.

9. The kit for personalizing a bath mat according to claim 7 wherein the one or more designated targets provide a surface for placement of the one or more customizing appliques.

* * * * *